US008333229B2

(12) United States Patent
Kimener

(10) Patent No.: US 8,333,229 B2
(45) Date of Patent: Dec. 18, 2012

(54) DRAFT ARRESTER

(75) Inventor: Thomas Terrence Kimener, Loveland, OH (US)

(73) Assignee: Rytec Corporation, Jackson, WI (US)

( * ) Notice: Subject to any disclaimer, the term of this patent is extended or adjusted under 35 U.S.C. 154(b) by 59 days.

(21) Appl. No.: 12/381,984

(22) Filed: Mar. 18, 2009

(65) Prior Publication Data

US 2009/0236053 A1 Sep. 24, 2009

Related U.S. Application Data

(60) Provisional application No. 61/069,969, filed on Mar. 18, 2008.

(51) Int. Cl.
*E04F 10/06* (2006.01)

(52) U.S. Cl. ..... 160/23.1; 160/242

(58) Field of Classification Search ..... 160/41, 160/238, 313, 293.1, 197, 266, 268.1, 270, 160/272, 271, 273.1, 242, 23.1, 121.1, 98, 160/120, 85, 86, 40, 122, 19; 52/173.2
See application file for complete search history.

(56) References Cited

U.S. PATENT DOCUMENTS

| | | | | | |
|---|---|---|---|---|---|
| 733,956 | A | * | 7/1903 | Glackin | 454/213 |
| 1,007,339 | A | * | 10/1911 | Collins | 160/23.1 |
| 1,740,816 | A | * | 12/1929 | Kaletay | 160/41 |
| 2,498,094 | A | * | 2/1950 | Plaum | 160/29 |
| 2,548,040 | A | * | 4/1951 | Morse | 160/25 |
| 3,156,293 | A | | 11/1964 | Reynolds | |
| 3,665,997 | A | * | 5/1972 | Smith et al. | 52/173.2 |
| 4,344,473 | A | * | 8/1982 | Shore | 160/121.1 |
| 4,344,474 | A | * | 8/1982 | Berman | 160/121.1 |
| 4,398,585 | A | * | 8/1983 | Marlow | 160/23.1 |
| 4,433,712 | A | * | 2/1984 | Mellon et al. | 160/122 |
| 4,453,584 | A | * | 6/1984 | Steele | 160/121.1 |
| 4,597,430 | A | * | 7/1986 | Marquez | 160/269 |
| 4,852,628 | A | | 8/1989 | Klein | |
| 4,947,597 | A | | 8/1990 | Simpson | |
| 5,138,811 | A | | 8/1992 | Parrott | |
| 5,183,093 | A | * | 2/1993 | Kraeutler | 160/84.06 |
| 5,222,541 | A | | 6/1993 | Hornberger | |
| 5,445,209 | A | * | 8/1995 | Lichy | 160/273.1 |
| 5,450,890 | A | * | 9/1995 | Pinkalla et al. | 160/121.1 |
| 5,566,736 | A | * | 10/1996 | Crider et al. | 160/121.1 |
| 5,632,317 | A | | 5/1997 | Krupke et al. | |
| 5,638,883 | A | | 6/1997 | Schulte | |
| 5,727,614 | A | | 3/1998 | Lichy | |
| 5,737,802 | A | | 4/1998 | Jella | |
| 5,758,705 | A | * | 6/1998 | Wagner et al. | 160/310 |
| 5,855,235 | A | * | 1/1999 | Colson et al. | 160/121.1 |
| 5,887,385 | A | | 3/1999 | Horner et al. | |

(Continued)

FOREIGN PATENT DOCUMENTS

EP 0 392 986 A2 10/1990

*Primary Examiner* — Katherine w Mitchell
*Assistant Examiner* — Johnnie A Shablack
(74) *Attorney, Agent, or Firm* — Factor Intellectual Property Law Group, Ltd.

(57) ABSTRACT

A draft arrester for an overhead door. An exemplary embodiment may include a flexible draft curtain extending between a ceiling structure and a wound-up portion of the overhead door. The draft arrester may include a follower assembly, which may include one or more rollers arranged to roll against the overhead door. An exemplary embodiment may include a repositionable arm arranged to press the rollers against the wound-up portion of the door.

19 Claims, 6 Drawing Sheets

U.S. PATENT DOCUMENTS 5,957,187 A 9/1999 Gruben et al.
6,089,305 A 7/2000 Gruben et al.
6,148,897 A 11/2000 Horner et al.
6,315,027 B1 11/2001 Lichy
6,321,822 B1 11/2001 Horner et al.
6,357,507 B1 * 3/2002 Stoebich et al. ..... 160/41
6,481,487 B2 * 11/2002 Simon ..... 160/84.06
6,550,191 B2 * 4/2003 Hoffmann et al. ..... 52/173.2
6,574,832 B1 * 6/2003 Boerger et al. ..... 16/90
6,666,251 B2 * 12/2003 Ikle ..... 160/120
6,698,490 B2 3/2004 Hoerner et al.
6,715,531 B2 * 4/2004 Simon ..... 160/271
6,792,998 B2 9/2004 David
6,860,311 B1 3/2005 Minor
6,942,003 B2 * 9/2005 Thompson ..... 160/268.1
6,964,289 B2 11/2005 Schulte
7,059,377 B2 * 6/2006 Nien et al. ..... 160/120
7,159,637 B2 * 1/2007 Snyder et al. ..... 160/121.1
7,185,463 B2 * 3/2007 Borgerding ..... 52/173.2
7,311,131 B2 * 12/2007 Nien et al. ..... 160/121.1
7,699,088 B2 * 4/2010 Coenraets ..... 160/113
7,806,160 B2 * 10/2010 Byeon ..... 160/85
7,810,544 B2 * 10/2010 Spiess ..... 160/242
7,828,037 B2 * 11/2010 Crider ..... 160/121.1
7,918,263 B2 * 4/2011 Kraeutler ..... 160/23.1
7,938,162 B2 * 5/2011 Duineveld ..... 160/121.1
2002/0059985 A1 * 5/2002 Stoebich et al. ..... 160/41
2006/0144530 A1 * 7/2006 Nagare et al. ..... 160/271
2007/0062650 A1 * 3/2007 Rejc ..... 160/133
2007/0277938 A1 * 12/2007 Crider ..... 160/121.1
2009/0159218 A1 * 6/2009 Duineveld ..... 160/121.1
2009/0236053 A1 * 9/2009 Kimener ..... 160/293.1
2010/0101739 A1 * 4/2010 Coenraets ..... 160/267.1

* cited by examiner

DRAFT ARRESTER

CROSS REFERENCE TO RELATED APPLICATION

This application claims the benefit of U.S. Provisional Application No. 61/069,969, filed Mar. 18, 2008, which is incorporated by reference.

BACKGROUND

The present disclosure is directed to draft arresters for overhead retractable doors and, more particularly, to non-contact draft arresters for roll-up overhead retractable doors.

INTRODUCTION TO THE INVENTION

Exemplary embodiments include a draft arrester for an overhead door. An exemplary embodiment may include a flexible draft curtain extending between a ceiling structure and a wound-up portion of the overhead door. The draft arrester may include a follower assembly, which may include one or more wheels arranged to roll against the overhead door. An exemplary embodiment may include a repositionable arm arranged to press the wheels against the wound-up portion of the door.

In an aspect, a draft arrester for a roll-up door may include a draft curtain including a lower end and an upper end; a first pair of spaced-apart wheels operatively coupled to the lower end of the draft curtain, the first pair of spaced-apart wheels biased against a portion of the roll-up overhead door; and a curtain support coupled to the upper end of the draft curtain and adapted to be mounted above the first pair of spaced-apart wheels.

In a detailed embodiment, the first pair of spaced apart wheels may be mounted approximate a first end of a first repositionable arm, and the first repositionable arm may be pivotable about a pivot located proximate a second end of the first repositionable arm. In a detailed embodiment, a draft arrester may include a spring component arranged to bias the first end of the first repositionable arm towards the portion of the door. In a detailed embodiment, at least one of the wheels may be weighted, and the weighted wheel may be arranged to bias the pair of spaced-apart wheels towards the portion of the door. In a detailed embodiment, a draft arrester may include a second pair of spaced-apart wheels operatively coupled to the first end of the draft curtain, the second pair of spaced-apart wheels being biased against the portion of the door. In a detailed embodiment, a draft arrester may include a substantially horizontal rail extending along the lower end of the draft curtain and interposing the first pair of spaced-apart wheels and the second pair of spaced-apart wheels. In a detailed embodiment, the draft curtain may be substantially flexible.

In an aspect, an overhead door assembly may include a rotatable roller; an overhead door windable onto the rotatable roller, the door being arranged to at least partially cover an opening having a width, a height, and at least one overhead boundary; a first wheeled follower biased against a portion of the overhead door wound around the rotatable roller; and a draft curtain extending vertically between the wheeled follower and the overhead boundary, while at the same time the draft curtain extends horizontally approximately the width of the opening.

In a detailed embodiment, the overhead boundary may be a ceiling. In a detailed embodiment, the draft curtain may be substantially flexible. In a detailed embodiment, the first wheeled follower may include a first pair of spaced-apart wheels mounted proximate a first end of a first repositionable arm, and a second end of the first repositionable arm may include a pivot. In a detailed embodiment, the first wheeled follower may include a spring component arranged to bias the first pair of spaced-apart wheels against the portion of the overhead door wound around the rotatable roller. In a detailed embodiment, at lease one of the wheels may be weighted, and the weighted wheel may be arranged to bias the first pair of spaced-apart wheels against the portion of the overhead door wound around the rotatable roller. In a detailed embodiment, an overhead door assembly may include a substantially horizontal rail extending from the first wheeled follower and along the draft curtain. In a detailed embodiment, an overhead door assembly may include a second wheeled follower biased against the portion of the overhead door wound around the rotatable wheel, and at least a portion of the substantially horizontal rail may interpose the first wheeled follower and the second wheeled follower.

In an aspect, a draftless overhead door may include a flexible overhead door; a rotatable roller adapted to have at least a portion of the flexible overhead door wound therearound; a motor operatively coupled to the rotatable roller to wind and unwind the flexible overhead door, where unwinding of the flexible overhead door lowers the flexible overhead door and winding of he flexible overhead door raises the flexible overhead door; a vertical door track arranged to guide movement of the flexible overhead door; a wheel biased against a portion of the flexible overhead door wound around the rotatable roller; and a curtain extending vertically between an upper structure and the wheel, while at the same time extending horizontally proximate a width of the overhead flexible door.

In a detailed aspect, an overhead door may include a spring component arranged to bias the wheel towards the rotatable roller. In a detailed embodiment, the wheel may be mounted to a first end of a repositionable arm, and a second end of the repositionable arm may include a pivot. In a detailed embodiment, the wheel may include a pair of spaced-apart wheels. In a detailed embodiment, the door may have a width, and the draft curtain may extend substantially the entire width of the door.

BRIEF DESCRIPTION OF THE DRAWINGS

The detailed description refers to the following figures in which.

DETAILED DESCRIPTION

Exemplary embodiments described and illustrated herein include apparatus and methods for inhibiting drafts over roll-up retractable doors. It will be apparent to those of ordinary skill in the art that the exemplary embodiments discussed herein are exemplary in nature and may be reconfigured without departing from the scope and spirit of the present invention. However, for clarity and precision, the exemplary embodiments as discussed herein may include optional steps, methods, and features that one of ordinary skill should recognize as not being a requisite to fall within the scope of the present disclosure as defined by the claims.

Figure 1:
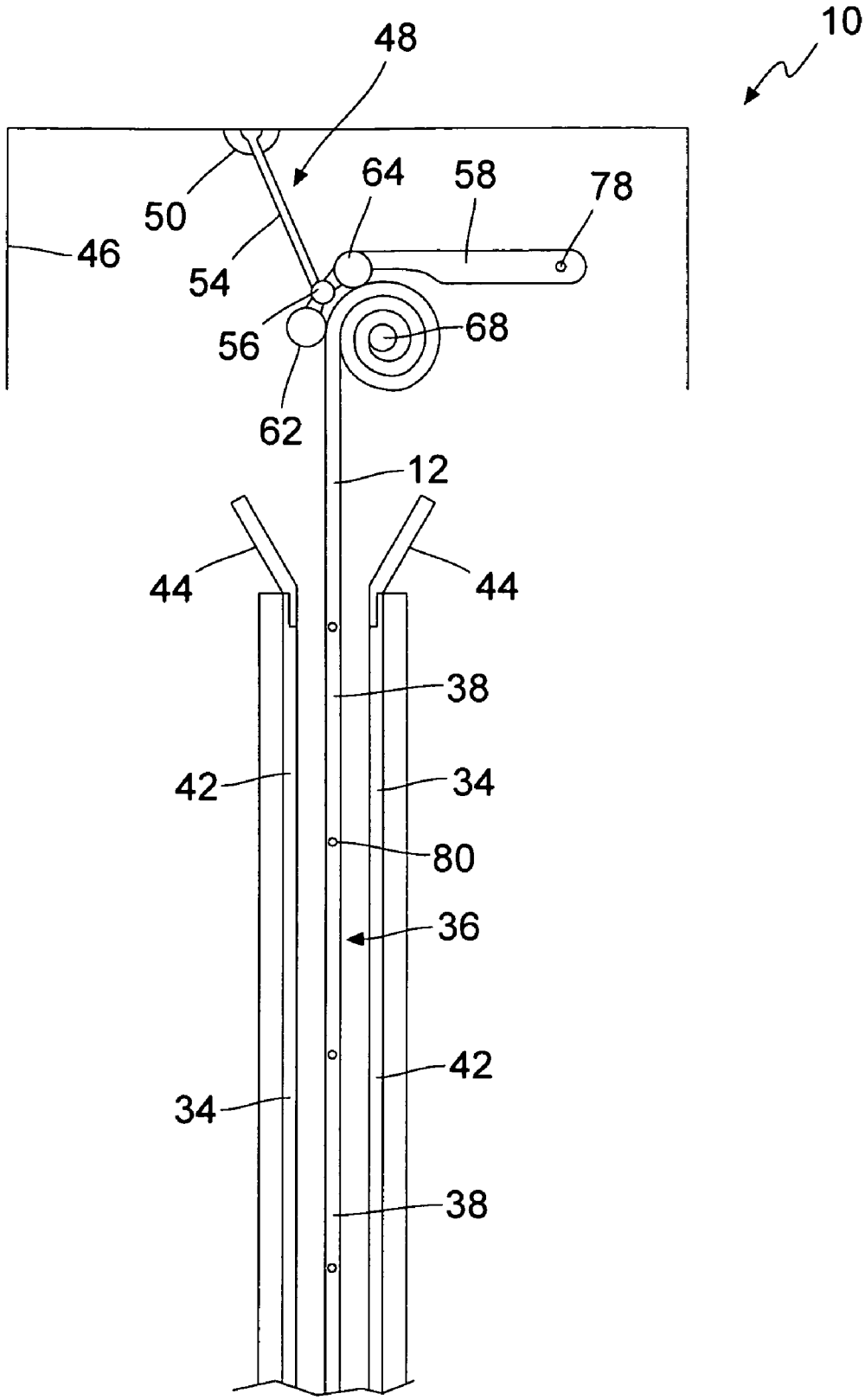
FIG. 1 is a cross-sectional view of a repositionable door incorporating an exemplary draft arrester, which may be operative to inhibit drafts between the door roll and the header, where the door is shown in a barrier position.
Figure 2:
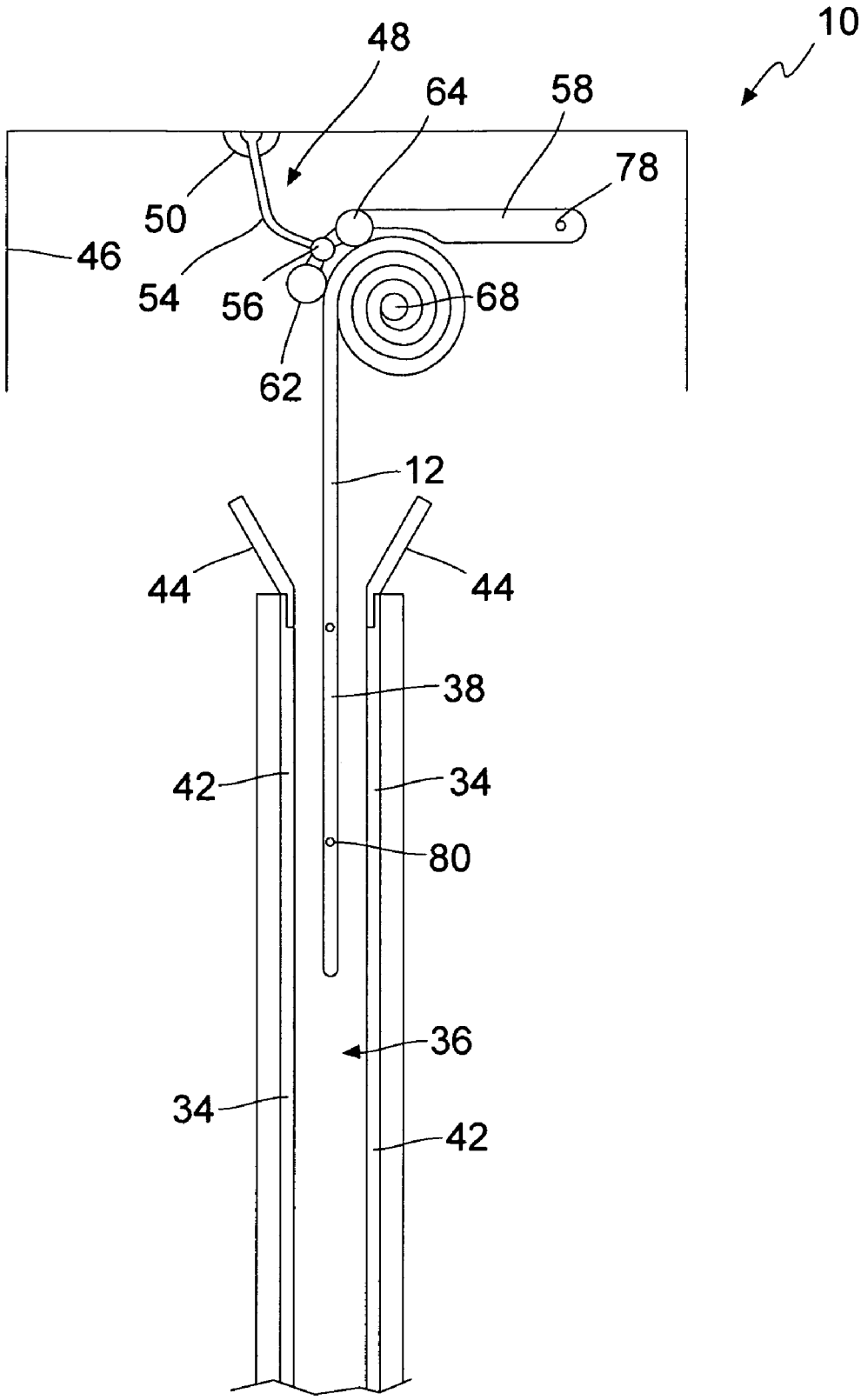
FIG. 2 is a cross-sectional view of a repositionable door incorporating the exemplary draft arrester of FIG. 1, where the door is shown in an intermediate position.
Figure 3:
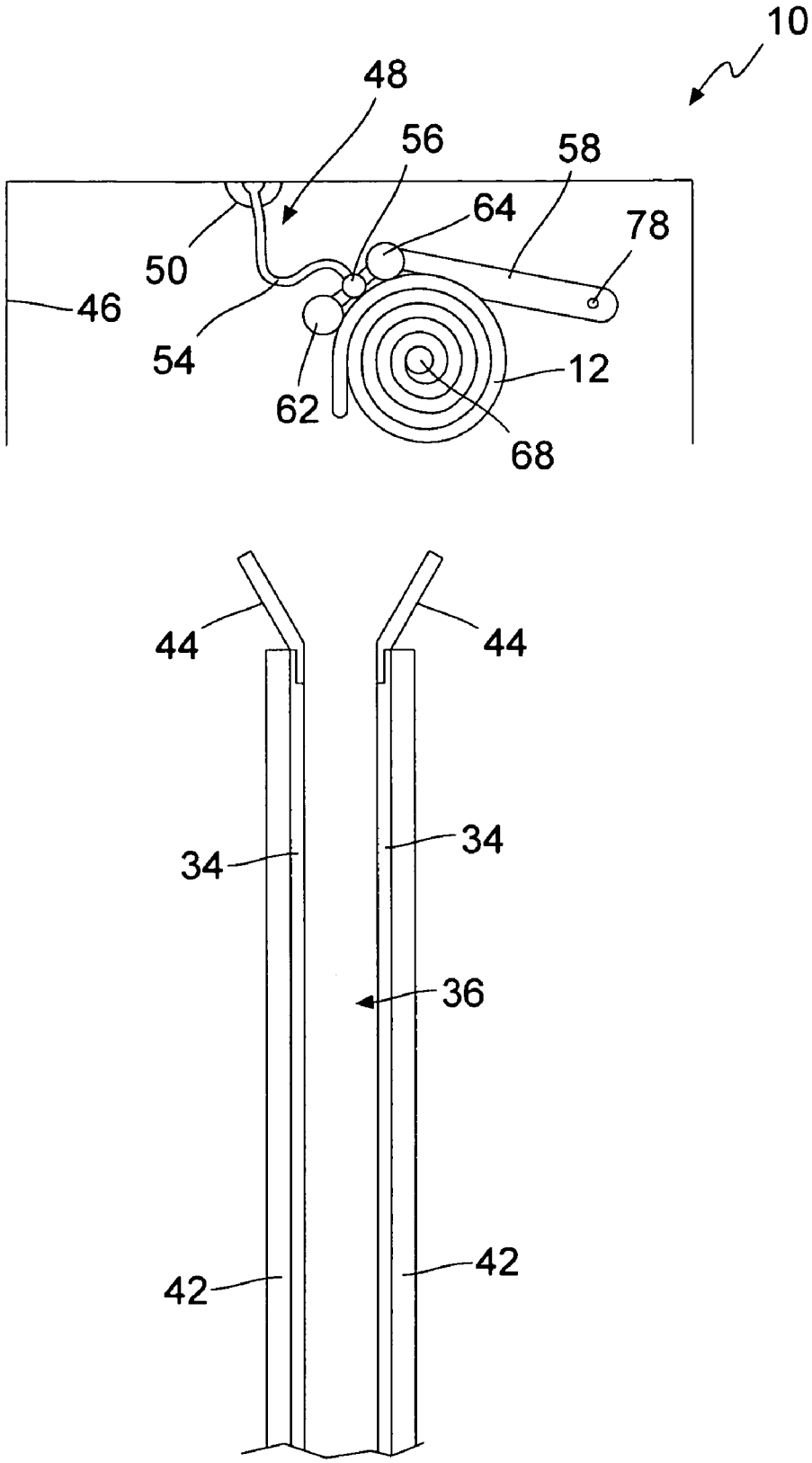
FIG. 3 is a cross-sectional view of a repositionable door incorporating the exemplary draft arrester of FIG. 1, where the door is shown in a retracted position.
Figure 4:
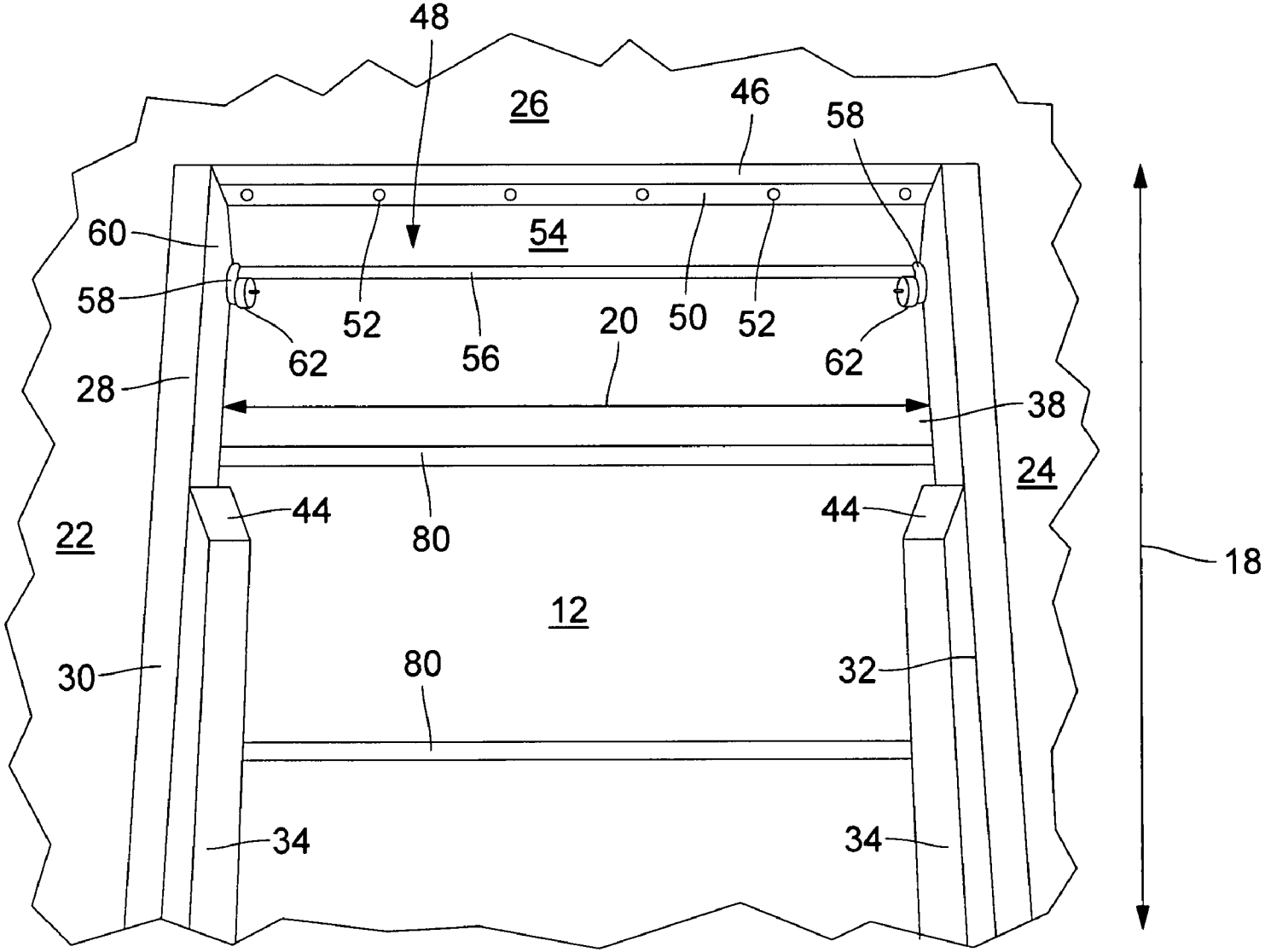
FIG. 4 is a frontal view, from the exterior, of an exemplary building opening incorporating a repositionable door and an exemplary draft arrester.
Figure 5:
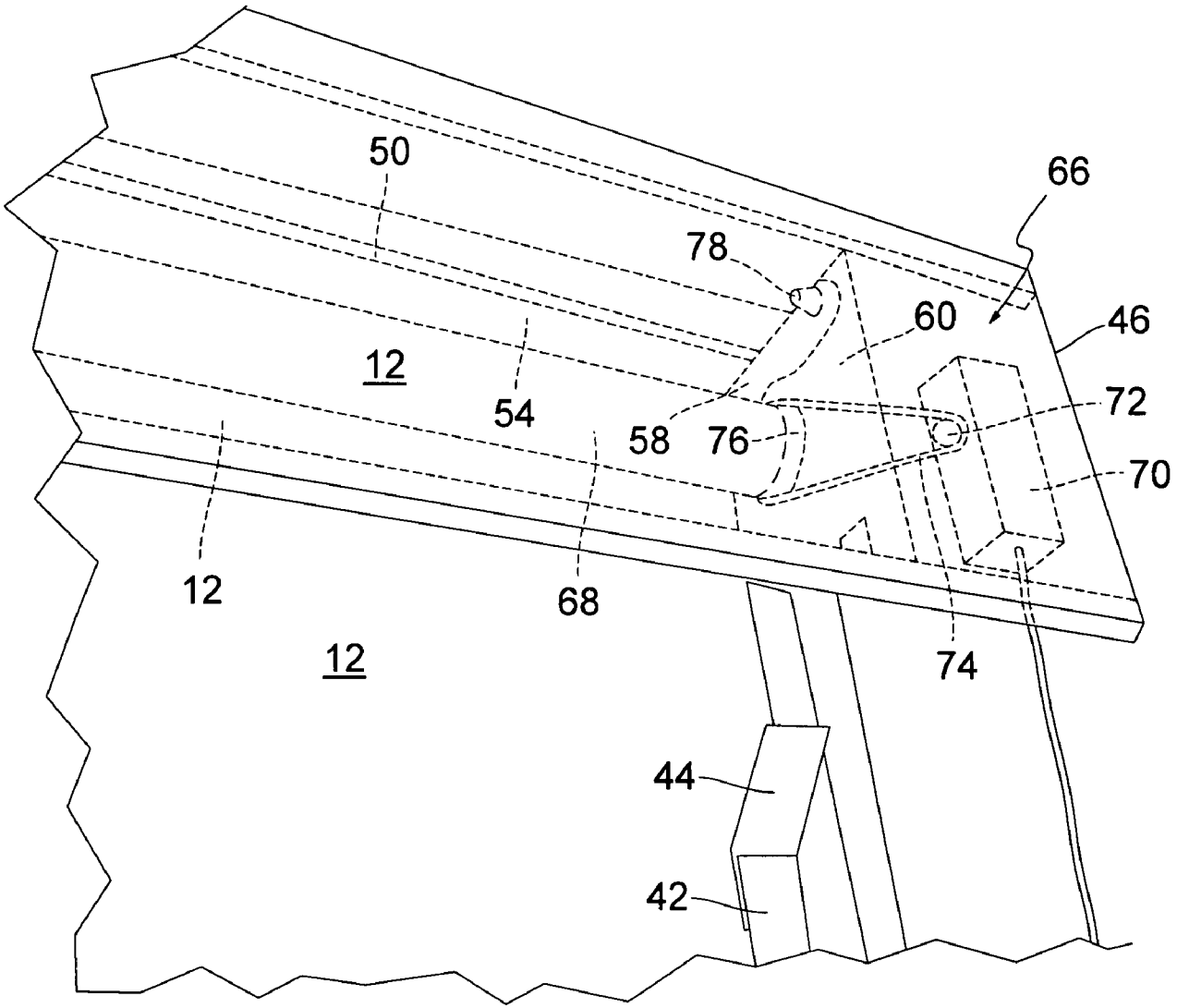
FIG. 5 is an elevated perspective view, from the interior, of one corner of an exemplary building opening incorporating a repositionable door and an exemplary draft arrester.
Figure 6:
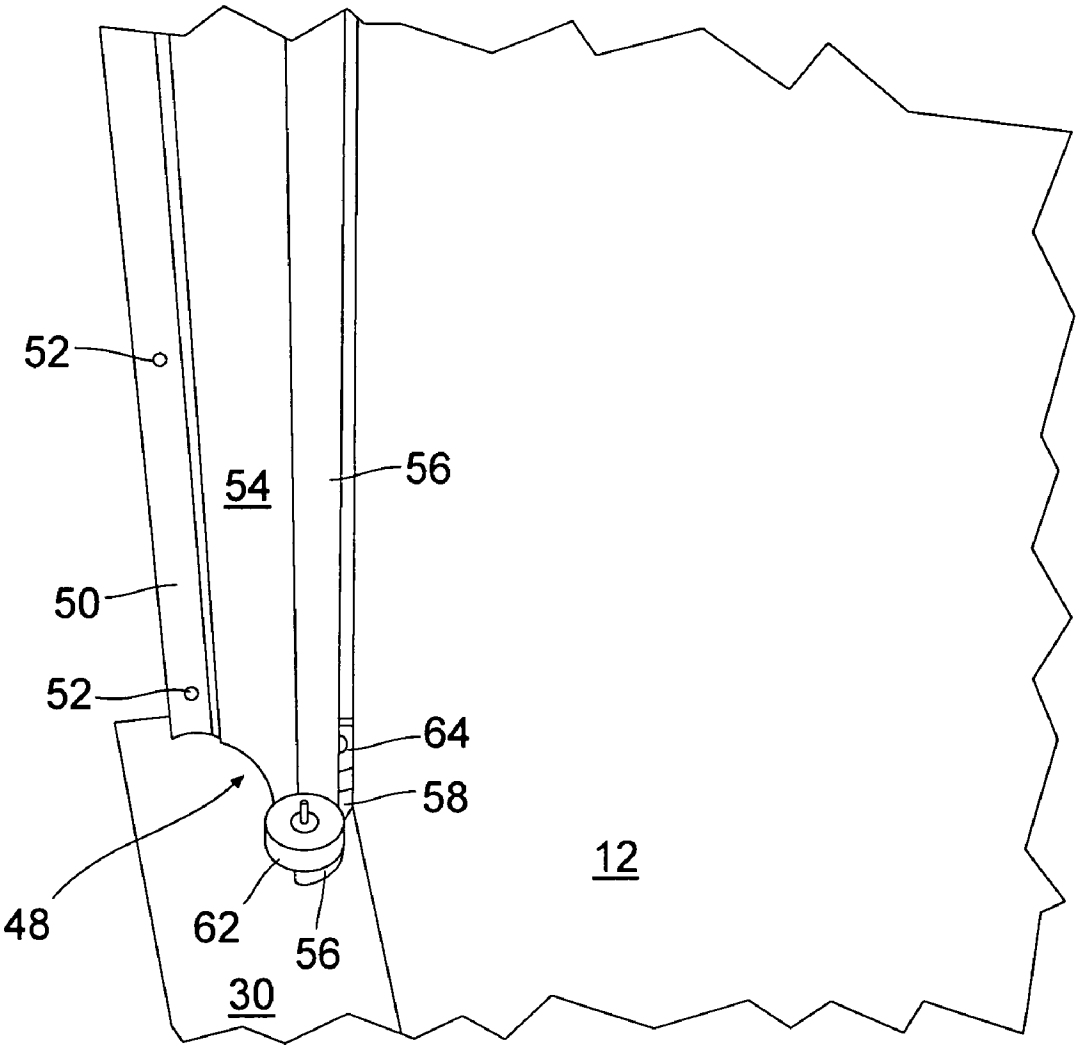
FIG. 6 is an elevated perspective view, from the exterior, of one corner of an exemplary building opening incorporating a repositionable door and an exemplary draft arrester.

An exemplary door draft arrester 10 is shown in FIGS. 1-6. In exemplary form, a door draft arrester 10 may be a component of a repositionable door 12, which may selectively close off an opening of a building. In exemplary form, the building may be a drive-through car wash, and the opening may be at the end of the car wash path through the building. For purposes of explanation only, the opening may be generally rectangular with a vertical lengthwise dimension 18 and a horizontal widthwise dimension 20. In an exemplary embodiment, the opening may be defined by generally vertically oriented left and right side walls 22, 24 and a generally horizontal header wall 26 which may spans overhead between the side walls 22, 24. The plane of the opening may interpose the interior of the building and its exterior.

In an exemplary embodiment, a door frame 28 may be inset within the interior of the building proximate the opening. The door frame 28 may include opposing vertical members 30, 32 that may be mounted respectively to the left and right side walls 22, 24. Each vertical member 30, 32 may include a pair of channel guides 34 that cooperate to define a vertical channel 36 into which lateral ends 38 of a repositionable door 12 may extend. In exemplary form, a channel guide 34 may comprise a vertically oriented angle iron segment 42 having a deflector 44 mounted to its proximal end. An exemplary deflector 44 is adapted to be angled outward away from the channel 36 so that adjacent deflectors 44 cooperate to provide a tapered mouth feeding into the channel 36. In this fashion, as the door 12 is repositioned from a retracted position toward a barrier position, the free horizontal end of the door may contact one of the deflectors 44, which may route lateral ends 38 of the door 12 into the channel 36. The precise dimensions of the angle iron segments 42 and deflectors 44 may be a matter of design choice. Likewise, the angle at which the deflectors 44 are oriented may be a matter of design choice; the greater the angle, the less gradual the taper.

In an exemplary embodiment, a horizontal header 46 that spans the complete widthwise dimension of the opening may be mounted on the interior side of the opening. In an exemplary form, the header may comprise a Lexan or metal boxed framework that mounts directly to the header wall 26 to provide a partial enclosure for a repositionable curtain assembly 48. The curtain assembly 48 may be mounted to the framework 46 by way of a generally horizontal molding 50, which may extend substantially the entire width of the opening, using a plurality of fasteners 52. A curtain 54 may be mounted to the header 46 by the molding 50. The curtain may be fabricated from the same material as the door 12. Nevertheless, it is to be understood that other materials could be utilized to fabricate the curtain 54 depending upon the end application. The curtain 54, in exemplary form, may be generally rectangular with its widthwise dimension dominating its lengthwise dimension. Specifically, it is the lengthwise dimension that may span between the molding 50 and a horizontal rail 56 mounted to a pair of opposing arms 58 mounted to corresponding perpendicular plates 60 extending from the upper portions of the left and right side walls 22, 24 and adjacent header wall 26. Each arm 58 may include a pair of wheels 62, 64 that may be interposed by the horizontal rail 56. Collectively, each arm 58 having pair of wheels 62, 64 may be referred to as a "wheeled follower." Each wheel, 62, 64 may be adapted to ride upon the exterior of the door 12 as it is rolled up responsive to the arm 58 being forced against the door roll. However, as the diameter of the door roll changes, whether increasing as the door is refracted or decreasing as the door is deployed, the arm 58 may force the wheels 62, 64 against the door roll to substantially maintain a constant axial gap between the horizontal rail 56 and door roll.

In an exemplary embodiment, the door 12 may be repositioned between a retracted position and a barrier position using a motor assembly 66. In exemplary form, one end of the door 12 may be mounted axially to a horizontal roller which may be turned either clockwise or counterclockwise by the motor assembly. The motor assembly 66 may include an electric motor 70 coupled to an output pulley 72 that repositions a belt 74 engaging a input pulley 76 coupled to the roller 68. It is too be understood, however, that various drive mechanisms could be utilized, such as using the output shaft of the motor 70 to directly engage the roller 68 or one could easily devise a set of gears to interface between the roller 68 and the motor 70 to accomplish a similar result. In an exemplary embodiment, as the roller 68 is rotated to move the door 12 toward its retracted position, the door 12 may wind around the roller 68 to provide a cylindrical roll (i.e., a "door roll") that gradually increases in diameter as the door is retracted until a maximum diameter is reached corresponding to substantially the entire door being wound around the roller 68. It should be noted, however, that it may not be necessary to wind the entire door around the shaft to allow egress of automobiles through the opening as in an exemplary carwash.

The present disclosure contemplates that a problem experienced with conventional roll-up doors is the occurrence of a draft between the header and the door roll. In some conventional door systems, the gap between the door roll and the header may vary and may be quite substantial to allow air to freely pass therebetween and create a draft that in certain instances is operative to allow liquids and other flowing materials within the interior of the building to escape or conversely to allow external fluids and debris to enter the building even while the door is in its barrier position. Exemplary embodiments described herein, however, may overcome these drawbacks by arresting the draft using the repositionable curtain assembly 48 to substantially decrease fluid flow between the horizontal shaft and header, thereby substantially decreasing any draft.

In an exemplary embodiment, the repositionable curtain assembly 48 may comprise a fixed length curtain 54 that may be mounted at one end to the molding 50 and may be mounted at an opposite end to the horizontal rail 56. In exemplary form, the horizontal rail 56 may be substantially in parallel with the door roll and/or roller 68 to maintain a substantially constant spacing between the rail 56 and door roll of approximately two inches. This constant spacing may be accomplished by providing a reactive system that starts with the reactive arms 58.

In an exemplary embodiment, each arm 58 may include a polyethylene unibody construction having a through hole 78 that receives a bolt extending from a corresponding perpendicular plate 60 toward the door roll. The end of the bolt may also receive a series of washers and/or a lock nut to provide play and freedom of movement rotationally between the bolt and the arm 58. In other words, this arrangement may allow each arm 58 to freely rotate/pivot around its corresponding bolt. This rotation may be caused by the change in diameter of the door roll as the door is either retracted or deployed. As discussed previously, each arm 58 may include a pair of wheels 62, 64 adapted to ride upon the exterior of the door as it is rolled up and/or down. In order to maintain the wheels against the exterior of the door roll, the arm 58 itself may be biased towards the door roll. This biasing may be accomplished by using weighted wheels that gravity directs against the door roll or alternatively using a spring biasing structure (not shown) circumscribing the bolt to apply a spring force resisting rotation of each arm 58. However, those skilled in the art will understand that other mechanisms may be used to maintain the wheels 62, 64 against the door roll in accordance with the present disclosure.

As mentioned previously, an exemplary door draft arrester 10 may find application in a carwash facility. By way of illustration, and not limitation, an exemplary draft arrester may be installed at the exit of a carwash. In exemplary form, an electric motor 70 may be electrically controlled by an automated control system (not shown) and at least one position sensor for sensing the presence of an automobile in proximity to the exit. Those skilled in the art are quite familiar with automated controls and a discussion of such a system in detail, with sensors, has been omitted for purposes of brevity. In exemplary operation, the door 12 may be selectively repositioned from a barrier position to a retracted position to allow egress of automobiles through the exit. Specifically, in a carwash, the door's default position may be the barrier position and movement of the door to the retracted position may only occur when the automated system senses an automobile in proximity to the exit or opening 14. At this time, the automated system may engage the electric motor 70 to rotate the roller 68 in the appropriate direction to retract the door from its barrier position (see FIG. 1) through an intermediary position (see FIG. 2) to a retracted position (see FIG. 3). As can be seen from the foregoing figures, repositioning of the door 12 does not compromise the draft arresting capabilities of the exemplary draft arrester.

In an exemplary embodiment, the curtain 54 may operate to substantially shut off the widthwise opening between the door roll and the header 46. As can be seen by the change in position of the arms 58, the wheels 62, 64 may continue to ride upon the exterior of the door roll and correspondingly pivot each arm 58 as the diameter of the door roll decreases (as the door is deployed) or increases (as the door is retracted). Correspondingly, the horizontal rail 56 mounted to each arm 58 at the rail's axial ends may maintain a substantially constant spacing from the door roll, regardless of the diameter of the door roll. To accommodate the changing door roll diameter, the curtain 54 may floats and/or deform. In an exemplary embodiment, at no time, however, does the deformation of the curtain 54 result in the absence of a barrier arresting drafts between the door roll and the header 46.

The material composition of the components of the instant invention may be a matter of design choice and may be selected from composites, metals, alloys, ceramics, plastics, or other materials. Those skilled in the art will recognize that different applications for an exemplary draft arrester may require selection of differing materials. By way of example, and not limitation, an exemplary repositionable door 12 may be fabricated from any weatherproof material and may include a series embedded horizontal ribs 80 to generally maintain the door in a planar orientation. The door material, by its nature may be flexible and able to be deformed, and may include weights (not shown) attached proximate to the exposed horizontal end of the door nearest the floor. One of the advantages of using a flexible door is that collisions with automobiles cause less damage to the door itself and the automobile.

Following from the above description and invention summaries, it should be apparent to those of ordinary skill in the art that, while the methods and apparatus herein described constitute an exemplary embodiments, the disclosure contained herein is not limited to these precise embodiments and that changes may be made without departing from the scope of the disclosure as defined by the claims (for example, and without limitation, it is within the scope of the invention that the base plate and cover plate take different forms, such as a box and a lid that are separate from each other or even connected by a hinge). Likewise, it is to be understood that it is not necessary to meet any or all of the identified advantages or objects disclosed herein in order to fall within the scope of any claim, since the invention is defined by the claims and since inherent and/or unforeseen advantages may exist even though they may not have been explicitly discussed herein. Finally, it will be apparent that additional claims may be inherent in the disclosure and may not be expressly described herein.

What is claimed is:

1. A draft arrester for a roll-up overhead door, the draft arrester comprising:

a substantially flexible draft curtain including a lower end and an upper end;

a first pair of spaced-apart wheels operatively coupled to the lower end of the draft curtain, the first pair of spaced-apart wheels biased against a portion of the roll-up overhead door; and a curtain support coupled to the upper end of the draft curtain and adapted to be mounted to a header of an overhead roll-up door, the header having a top panel wherein the draft curtain is mounted so as to substantially extend between the top panel of the door header and at least one of a portion of the roll-up overhead door wound around a rotatable roller and the rotatable roller and the draft curtain is capable of dynamically flexing and extending in response to the door panel winding and unwinding around the rotatable roller.

2. The draft arrester of claim 1, further comprising a second pair of spaced-apart wheels operatively coupled to the first end of the draft curtain, the second pair of spaced-apart wheels biased against the portion of the door.

3. The draft arrester of claim 2, further comprising a substantially horizontal rail extending along the lower end of the draft curtain and interposing the first pair of spaced-apart wheels and the second pair of spaced-apart wheels.

4. The draft arrester of claim 1, wherein the first pair of spaced apart wheels is mounted approximate a first end of a first repositionable arm; and wherein the first repositionable arm is pivotable about a pivot located proximate a second end of the first repositionable arm.

5. The draft arrester of claim 4, further comprising a spring component arranged to bias the first end of the repositionable arm towards the portion of the door.

6. The draft arrester of claim 4, wherein at least one of the wheels is weighted; and wherein the weighted wheel is arranged to bias the pair of spaced-apart wheels towards the portion of the door.

7. An overhead door assembly comprising:

a rotatable roller;

an overhead door having a top edge, a bottom edge, and opposing side edges windable onto the rotatable roller, the door being arranged such that the bottom edge is capable of vertical movement proximate an opening having a width, a height, and at least one overhead boundary as the door panel is wound and unwound to at least partially cover and uncover the opening;

a header housing at least a portion of the rotatable roller and any portion of the door wound around the rotatable roller;

a first wheeled follower biased against at least one of the portion of the overhead door wound around the rotatable roller and the rotatable roller; and a draft curtain extending vertically between the wheeled follower and the header, while at the same time the draft curtain extends horizontally approximately the width of the opening, the draft curtain having one end substantially touching an upper most portion of the header.

8. The overhead door assembly of claim 7, wherein the overhead boundary is a ceiling.

9. The overhead door assembly of claim 7, wherein the draft curtain is substantially flexible.

10. The overhead door assembly of claim 7, wherein the first wheeled follower includes a first pair of spaced-apart wheels mounted proximate a first end of a first repositionable arm; and wherein a second end of the first repositionable arm includes a pivot.

11. The overhead door assembly of claim 10, wherein the first wheeled follower includes a spring component arranged to bias the first pair of spaced-apart wheels against the portion of the overhead door wound around the rotatable roller.

12. The overhead door assembly of claim 10, wherein at least one of the wheels is weighted; and wherein the weighted wheel is arranged to bias the first pair of spaced-apart wheels against the portion of the overhead door wound around the rotatable roller.

13. The overhead door assembly of claim 10, further comprising a substantially horizontal rail extending from the first wheeled follower and along the draft curtain.

14. The overhead door assembly of claim 13, further comprising a second wheeled follower biased against the portion of the overhead door wound around the rotatable roller; wherein at least a portion of the substantially horizontal rail interposes the first wheeled follower and the second wheeled follower.

15. A draftless overhead door comprising:

a flexible overhead door;

a rotatable roller adapted to have at least a portion of the flexible overhead door wound and unwound there from;

a motor operatively coupled to the rotatable roller to wind and unwind the flexible overhead door, where unwinding of the flexible overhead door lowers the flexible overhead door and winding of the flexible overhead door raises the flexible overhead door;

a vertical door track arranged to guide movement of the flexible overhead door;

a header housing at least a portion of the rotatable roller, the motor, and any portion of the flexible overhead door wound around the rotatable roller;

a wheel biased against at least a portion of the flexible overhead door wound around the rotatable roller or the rotatable roller; and a curtain attached to and extending vertically between an upper most panel of the header and the wheel, while at the same time extending horizontally proximate a width of the overhead flexible door.

16. The overhead door of claim 15, further including a spring component arranged to bias the roller towards the rotatable roller.

17. The overhead door of claim 15, wherein the roller is mounted to a first end of a repositionable arm; and wherein a second end of the repositionable arm includes a pivot.

18. The overhead door of claim 15, wherein the wheel biased against the portion of the flexible overhead door wound around the rotatable roller includes a pair of spaced-apart wheels.

19. The overhead door assembly of claim 15, wherein the door has a width; and wherein the draft curtain extends substantially the entire width of the door.

* * * * *